US012390023B2

(12) United States Patent
Milam et al.

(10) Patent No.: US 12,390,023 B2
(45) **Date of Patent: *Aug. 19, 2025**

(54) BACKSTOP FOR SHELVING UNIT

(71) Applicant: Walmart Apollo, LLC, Bentonville, AR (US)

(72) Inventors: Christopher Paul Milam, Cave Springs, AR (US); Ronald Andrew March, Bentonville, AR (US); Nancy Lopez-Arroyo, Rogers, AR (US); Justin Lee Maloney, Rogers, AR (US); Katie Marie Lafferty, Bentonville, AR (US); Clancy Monroe Milam, Cave Springs, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/426,806

(22) Filed: Jan. 30, 2024

(65) Prior Publication Data

US 2025/0241461 A1 Jul. 31, 2025

(51) Int. Cl.
*A47F 5/00* (2006.01)
*A47B 57/58* (2006.01)

(52) U.S. Cl.
CPC ..... *A47F 5/0043* (2013.01); *A47B 57/588* (2013.01); *A47F 5/0068* (2013.01)

(58) Field of Classification Search
CPC ..... A47F 5/0043; A47F 5/005; A47F 5/0068; A47F 2009/041; A47B 57/588; A47B 65/15; A47B 96/04; A47B 2220/0063; A47B 96/201
USPC ..... 211/119.003, 2, 184, 183; 312/140.4; 108/27, 161
See application file for complete search history.

(56) References Cited

U.S. PATENT DOCUMENTS 2,785,937 A * 3/1957 Murray ..... A47B 77/022 108/42
2,855,258 A * 10/1958 Moncier ..... A47F 5/005 211/184
3,027,017 A * 3/1962 Luxeder ..... B60P 7/0892 410/121
3,102,499 A * 9/1963 Shelor ..... A47B 96/07 108/6
3,181,703 A * 5/1965 Dunham ..... A47F 5/0025 211/162
3,202,290 A * 8/1965 Harvey ..... A47B 65/10 211/184
3,497,081 A * 2/1970 Field ..... A47B 57/58 211/184
3,561,608 A * 2/1971 Weider ..... B65G 1/02 211/183
3,752,548 A * 8/1973 Betts ..... A47B 77/06 312/140.4

(Continued)

OTHER PUBLICATIONS

Shop Fitting Store "Single Sided Pegboard Gondola White", Jan. 24, 2024 (Date of PDF download).

*Primary Examiner* — Jennifer E. Novosad
(74) *Attorney, Agent, or Firm* — Foley IP Law, PLLC

(57) ABSTRACT

A backstop configured to be implemented on a shelf. The backstop includes a bottom portion, a back portion in continuous communication with a back edge of the bottom portion, and a plurality of prongs disposed along a front edge of the bottom portion.

12 Claims, 7 Drawing Sheets

(56) References Cited

U.S. PATENT DOCUMENTS 3,827,574 A * 8/1974 Craig, Sr. ..... A47F 5/005 211/184
3,868,021 A * 2/1975 Heinrich ..... E05D 15/0682 211/184
3,872,976 A * 3/1975 Moore ..... A47F 5/005 211/184
3,954,184 A * 5/1976 Mendenhall ..... A47F 5/005 211/184
4,073,384 A * 2/1978 Celeste ..... A47F 5/0043 211/49.1
4,181,229 A * 1/1980 Moore ..... A47F 5/005 211/184
4,191,110 A * 3/1980 Klukos ..... A47B 96/02 248/235
4,923,260 A * 5/1990 Poulsen ..... F25D 25/02 211/186
4,942,968 A * 7/1990 Fast ..... A47F 5/005 211/184
5,064,158 A * 11/1991 Brazier ..... A47B 96/063 211/90.01
5,096,074 A * 3/1992 Merl ..... A47F 5/103 211/186
5,121,681 A * 6/1992 Chang ..... A47B 65/10 108/65
5,148,927 A * 9/1992 Gebka ..... A47F 5/005 211/184
5,181,623 A * 1/1993 Linden ..... A47B 57/04 211/183
5,209,360 A * 5/1993 Valiulis ..... A47F 5/0056 211/184
5,406,894 A * 4/1995 Herrmann ..... A47B 96/062 248/250
5,452,666 A * 9/1995 Peters ..... A47B 77/06 312/140.4
5,518,309 A * 5/1996 St-Pierre ..... D06F 39/12 297/182
5,733,022 A * 3/1998 Whetstone ..... A47B 77/022 4/631
5,799,803 A * 9/1998 Muller ..... A47B 96/02 211/90.01
5,921,412 A * 7/1999 Merl ..... A47F 5/13 211/90.03
6,044,989 A * 4/2000 Sosso ..... A47F 5/005 211/184
6,098,821 A * 8/2000 Dube ..... A47B 57/588 211/184
6,115,982 A * 9/2000 Lindenberg ..... A47B 77/022 52/287.1
6,173,846 B1 * 1/2001 Anderson ..... A47B 47/027 211/183
6,290,077 B2 * 9/2001 Sosso ..... A47F 5/005 211/184
6,629,617 B2 * 10/2003 Osawa ..... A47F 5/16 211/119.003
6,685,037 B1 * 2/2004 Zadak ..... A47B 57/58 211/184
7,055,918 B2 * 6/2006 LaChance ..... F16B 12/00 312/140.3
7,140,206 B2 * 11/2006 Braun ..... D06F 31/00 68/3 R
7,314,145 B2 * 1/2008 Rodrigues ..... A47F 9/04 211/184
7,568,583 B2 * 8/2009 Wing ..... F25D 25/02 211/184
7,736,711 B2 * 6/2010 Dobelle ..... A47B 95/043 312/246
7,784,238 B2 * 8/2010 Bannister ..... E04F 19/066 52/287.1
8,087,522 B2 * 1/2012 Stafford ..... A47F 5/10 211/119.003
8,104,630 B2 * 1/2012 Schneider ..... A47F 5/005 211/184
8,113,360 B2 * 2/2012 Olson ..... A47F 5/005 211/59.3
8,172,094 B2 * 5/2012 Meyer ..... A47F 5/005 211/59.3
8,196,931 B2 * 6/2012 Burgess ..... F16J 15/061 277/642
8,333,285 B2 * 12/2012 Kiehnau ..... A47F 5/0068 211/119.003
D707,994 S 7/2014 Le
8,763,819 B2 * 7/2014 Theisen ..... A47F 7/0028 211/119.003
8,939,521 B2 * 1/2015 Barenbrugge ..... A47F 5/005 211/183
9,004,427 B2 * 4/2015 Irudayaraj ..... A47B 96/061 211/144
9,351,590 B1 5/2016 Wildrick et al.
9,629,483 B2 * 4/2017 Walker ..... A47F 5/005
11,737,585 B2 * 8/2023 Smedley ..... A47F 5/16 211/132.1
2003/0173323 A1 * 9/2003 Mings ..... A47F 5/0043 211/183
2005/0133474 A1 * 6/2005 Nomoto ..... A47F 7/0078 211/186
2005/0139560 A1 * 6/2005 Whiteside ..... A47B 57/586 211/119.003
2006/0016774 A1 1/2006 Bustos
2006/0096938 A1 * 5/2006 Kanou ..... A47F 3/0486 211/184
2011/0062096 A1 * 3/2011 Sparkowski ..... G09F 3/204 211/59.3
2012/0111764 A1 * 5/2012 Lackey ..... B31B 50/99 206/736
2015/0230630 A1 * 8/2015 Taylor ..... A47F 5/16 211/132.1
2020/0214475 A1 * 7/2020 Zussman ..... A47F 1/125
2021/0227999 A1 * 7/2021 Smedley ..... A47B 45/00

* cited by examiner

BACKSTOP FOR SHELVING UNIT

BACKGROUND

Gondola shelving is widely used in retail and other environments for product placement, display, or storage. Standard shelving is implemented in these environments to create aisles or passageways, with two shelving units arranged back to back, forming an aisle or passageway on either side of the front portion of the shelving unit. Multiple shelves are provided with each unit, offering shelves at varying height intervals, and often additional storage at the top-most shelf.

SUMMARY

The following presents a simplified summary of the disclosure in order to provide a basic understanding to the reader. This summary is not intended to identify key features or essential features of the claimed subject matter nor is it intended to be used to limit the scope of the claimed subject matter. Its sole purpose is to present a selection of concepts disclosed herein in a simplified form as a prelude to the more detailed description that is presented later.

According to a first aspect an apparatus configured to be implemented on a shelf is described. The backstop includes a bottom portion, a back portion in continuous communication with a back edge of the bottom portion, and a plurality of prongs disposed along a front edge of the bottom portion.

According to a second aspect a backstop configured to be implemented on a shelf is described. The backstop includes a bottom portion, a back portion in continuous communication with a back edge of the bottom portion, and a plurality of prongs disposed along a front edge of the bottom portion.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
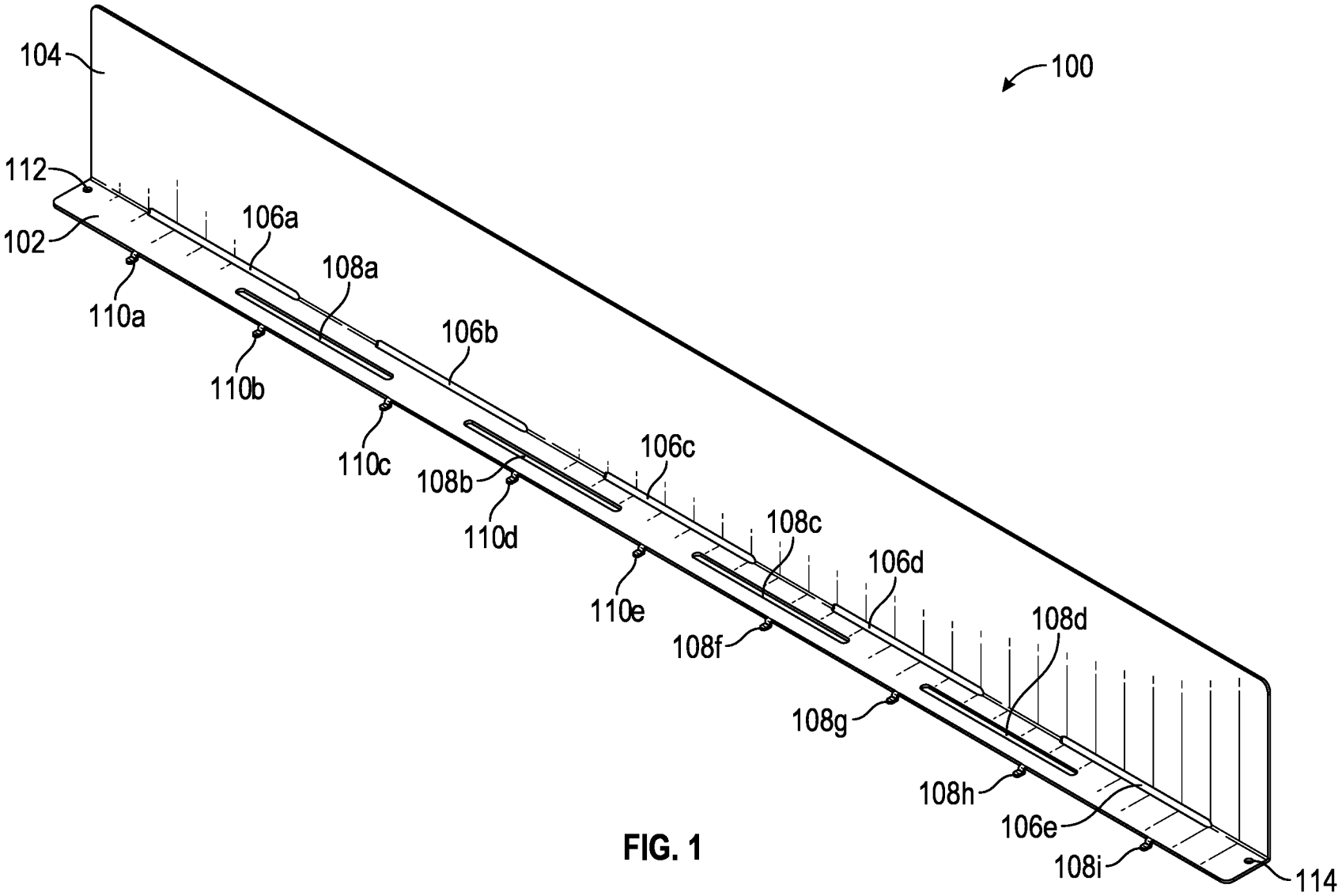
FIG. 1 is an isometric view of an exemplary backstop for a shelving unit according to an implementation.

The detailed description provided below in connection with the appended drawings is intended as a description of the present examples and is not intended to represent the only forms in which the present examples are constructed or utilized. The description sets forth the functions of the examples and the sequence of operations for constructing and operating the examples. However, the same or equivalent functions and sequences may be accomplished by different examples.

While various spatial and directional terms, such as "top," "bottom," "front," "rear," "upper," "lower," "vertical," "upward," and/or the like are used to describe implementations of the present application, it is understood that such terms are merely used with respect to the orientations shown in the drawings. The orientations can be inverted, rotated, or otherwise changed such that the spatial and directional terms apply differently, for example if the structure is flipped 180°; a top side becomes a bottom side; upward becomes downward; a left side becomes a right side; vice versa; and/or the like. Moreover, and for example, vertical may become horizontal when the structure is rotated 90°.

Standard commercial shelving, often referred to as gondola shelving, is typically implemented with two shelving units arranged back to back, forming an aisle or passageway on either side of the front portion of the shelving unit. This back-to-back configuration leaves a space between the back of the two shelving units, by virtue of the dimensionality and configuration of the units and the components thereof. A pegboard is often installed in this space between the backside of two units, however there remains a gap between the back portion of the individual shelves of the unit and the pegboard. In some examples, this gap leaves a two inch (2") space between the back of the shelf and the pegboard.

This gap existing between the back of the shelf and the pegboard allows items or products to fall off of the back of the shelf and behind the shelving unit. Often, the product that falls into this gap is undetected and inaccessible. This results in a loss of inventory and revenue for the company. It also increases costs with time spent reconciling inventory discrepancies due to the products that have gone missing into the gap, leads to inaccurate inventory data, and other resource expenditures.

Another issue with current shelving units and configurations arises when inventory is added, or re-stocked, at the front of the shelf. When a user (i.e., human associate, robot picker, and the like) adds items at the front of the shelf, the user often pushes the existing or remaining items on the shelf back to make additional room at the front to add more items. With the addition of new items pushing current items on the shelf towards the back, product that is too large to fall within the gap will push up against the pegboard, often causing damage to the pegboard, or displacing the pegboard from the correct position altogether. The damage to the pegboards further increases costs, requiring additional resources to replace the damaged pegboards.

Aspects of the disclosure provide a backstop for a shelving unit that is configured to be implemented at the back of a shelf on a shelving unit, preventing inventory from falling off the back of the shelf and behind the shelving unit and further preventing inventory from coming into contact with the pegboard. The backstop is configured to sit flush atop the back of the shelf, with prongs that fit into existing cutout portions along the surface of the shelf in standard shelving. Additionally, as will be further described below, the backstop includes features to allow for fluid flow, such as airflow or water for example, through the fixture.

Referring now to FIG. 1, according to an implementation, a backstop 100 includes a bottom portion 102 and a back portion 104 forming a ninety degree (90°) angle of the backstop 100. In some examples, the bottom portion 102 and back portion 104 are formed from one continuous material, forming the angle through suitable means during manufacturing, and are not otherwise joined together by a separate component. In other words, in this example, the backstop is made from a single piece of material, which may be a piece of stamped metal bent or formed into the desired shape in some examples, and where the bottom portion and the back portion of the single piece of material are in continuous communication, but for optional apertures stamped into the metal. Other methods of forming backstop 100 from a single material may include press braking, flanging, die bending, point bending, gap pressing, ram bending, folding and edging, or any other suitable mean of conforming a piece of material into the depicted shape. In other examples, one or more materials may be used to form the backstop.

The backstop 100 may be formed using any suitable material having some degree of rigidity that provides relative resistance to force and deformation. In some examples, backstop 100 is formed using sheet steel. In other examples, backstop 100 may be formed of any other suitable material, such as, without limitation, durable hardwood, engineered wood, plywood, silicon, acrylic, plastic, plexiglass, or other forms of metal such as, without limitation, aluminum, copper, bronze, stainless steel, brass, titanium, and the like.

As depicted in FIG. 1, the back portion 104 is substantially solid, having apertures, or openings, disposed at intervals along the juncture of the back portion 104 and the bottom portion 102 of the backstop 100. In some examples, apertures 106*a*-106*e* are elliptical or substantially elongated and elliptical in form. In other examples, these apertures may form other shapes or geometric dimension. These apertures 106*a*-106*e* allow for fluid flow through the backstop 100. In some examples, the fluid flow is airflow. In other examples, the fluid flow is water or other fluids implemented as needed for fire suppression, allowing fluid flow throughout the backstop and the shelving unit fixture as a whole.

The bottom portion 102 further optionally includes apertures 108*a*-108*d*, which are openings that allow for fluid flow similar to apertures 106*a*-106*e*. Apertures 108*a*-108*d* are disposed along bottom portion 102, which sits flush against the shelf when implemented on a shelving unit. Standard shelves have a plurality of cut-out apertures, or openings, along the surface of the shelf. Often, these cutouts are diamond shaped, and are distributed along the back of the shelf in one or more set patterns and spacing configurations. These patterns and spacing configurations are known in the industry by one of skill in the art. Apertures 108*a*-108*d* will overlap with one or more of the cut-out openings of a shelf, allowing further fluid flow through backstop 100 and through the shelf when implemented. In some examples, apertures 108*a*-108*d* are elliptical or substantially elongated and elliptical in form. In other examples, these apertures may form other shapes or geometric dimension.

Bottom portion 102 further includes prongs 110*a*-110*i*, disposed in intervals along the front edge of bottom portion 102. Prongs 110*a*-110*i* are disposed in intervals that match at least one interval spacing pattern or configuration of cut-out apertures in shelf surfaces of standard shelving, such that the prongs readily fit into at least some of the cut-out openings of a shelf to removably secure the backstop 100 to the shelf. The prongs provide sufficient support to secure the backstop to the shelf utilizing the pattern of apertures in the shelf surface, and provide sufficient resistance to maintain the position and integrity of the backstop when secured to the shelf in this manner, even if reasonable force is applied against the backstop when implemented.

Bottom portion 102 also optionally includes fastening aperture 112 and fastening aperture 114, which in some examples are openings provided to enable compatibility with other existing systems or other apparatus that may also be implemented within or on shelving systems, such as Pusher track systems for example. In these examples, fastening apertures 112 and fastening aperture 114 allow another system or another apparatus to be fastened through the backstop 100 and onto the shelf, such that implementation of backstop 100 does not preclude implementation of other compatible systems. In other examples, fastening aperture 112 and fastening aperture 114 are openings provided as an additional feature to further secure backstop 100 to a shelf with the addition of a fastener. A fastener is disposed through fastening aperture 112 and fastening aperture 114 and through corresponding apertures in a shelf to secure the backstop 100 to a shelf in these other examples. A fastener may be any suitable fastening means, such as, without limitation, a screw, a bolt, a pin, or any other suitable fastener.

Although a specific number of apertures and prongs are depicted in a particular interval spacing in the illustrative example of FIG. 1, nothing in FIG. 1 should be construed as limiting the number or spacing of the apertures or prongs. Any number of apertures and/or prongs may be contemplated by this disclosure, in any interval spacing. Furthermore, the illustrative height depicted for back portion 104 is not intended to limit the relative height of the back portion in relation to the bottom portion or in relation to a shelving unit. Any suitable height may be contemplated by this disclosure.

Figure 2:
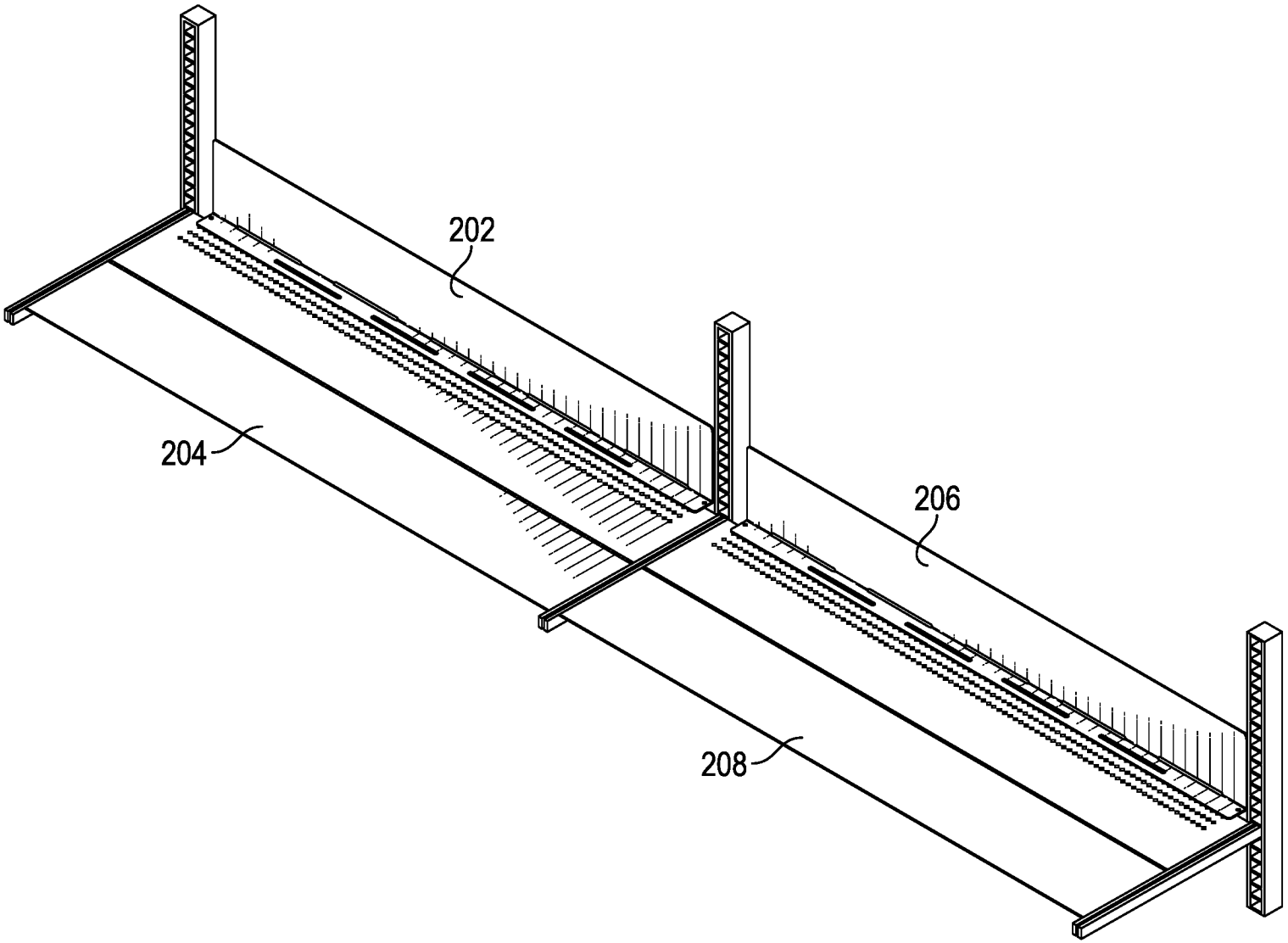
FIG. 2 is an isometric view of the exemplary backstop shown in FIG. 1 illustrating the backstop on a shelving unit according to an implementation.

Referring now to FIG. 2, instances of the backstop 100 described in FIG. 1 are depicted as implemented on shelves of a shelving unit. Backstop 202 is implemented on shelf 204 and backstop 206 is implemented on shelf 208. Shelf 204 and shelf 208 have a plurality of openings disposed along the back surface of the shelf in an illustrative example. The pattern and spacing of the openings depicted on the shelf surfaces are not intended to be construed as limiting and are provided for illustrative purposes only. As illustrated here, shelf 204 and shelf 208 are configured in a side by side manner with attachment to vertical elements. FIG. 2 is an example of shelves that may be disposed at varying heights along the vertical plane of a shelving unit.

Figure 3:
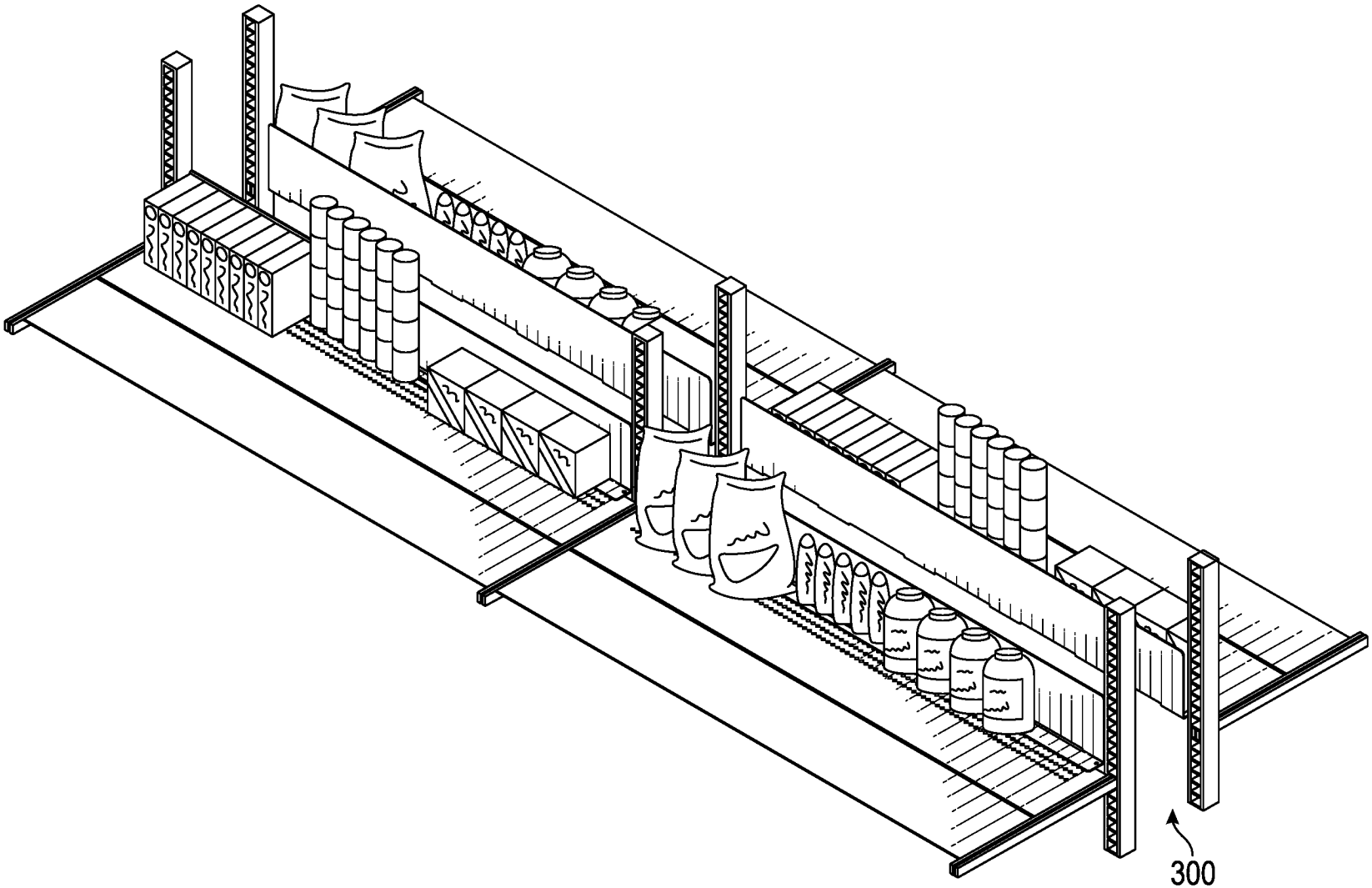
FIG. 3 is an illustrative view of the backstop shown in FIGS. 1 and 2 illustrating the backstop on a shelving unit having items thereon according to an implementation.

Referring now to FIG. 3, instances of the backstop 100 described in FIG. 1 and backstop 202 and 206 in FIG. 2 are depicted as implemented with inventory, or items, upon the shelves. This illustrative example depicts the space 300 between the two back-to-back shelving units and the prevention provided by the backstops for inventory on the shelves to be pushed off, or otherwise fall off the back of the shelves and into the space between the units.

Figure 4:
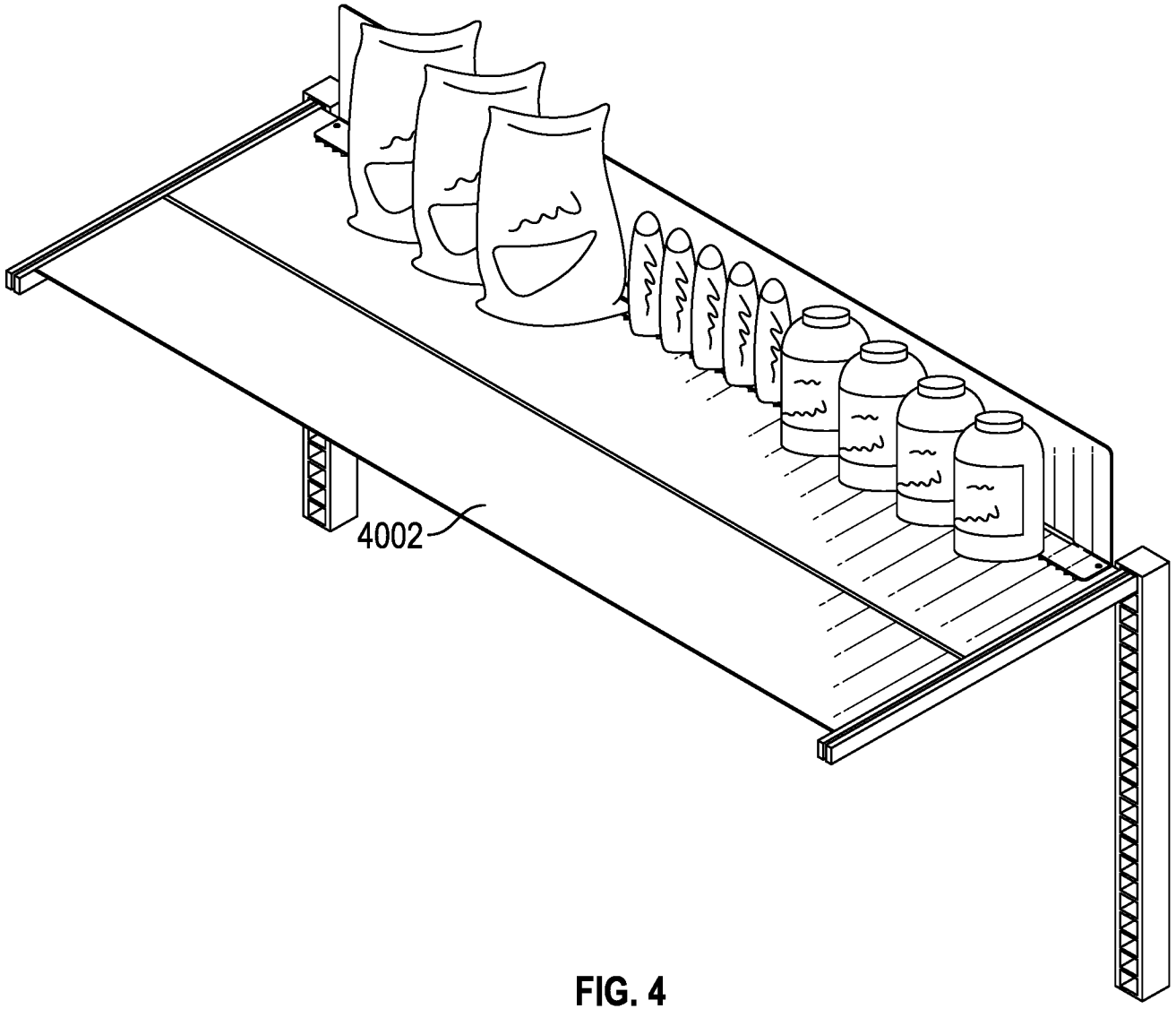
FIG. 4 is an illustrative view of the exemplary backstop shown in FIG. 1 illustrating the backstop on a top-most shelf of a shelving unit according to an implementation.

Referring now to FIG. 4, an instance of the backstop 100 described in FIG. 1 is depicted as implemented on a top-most shelf 400 with inventory, or items, upon the top-most shelf. The top-most shelf of a unit is often referred to as a topstock area. The backstop 100 is configured to be implemented on any shelf of a shelving unit, including the top-most shelf.

Figure 5:
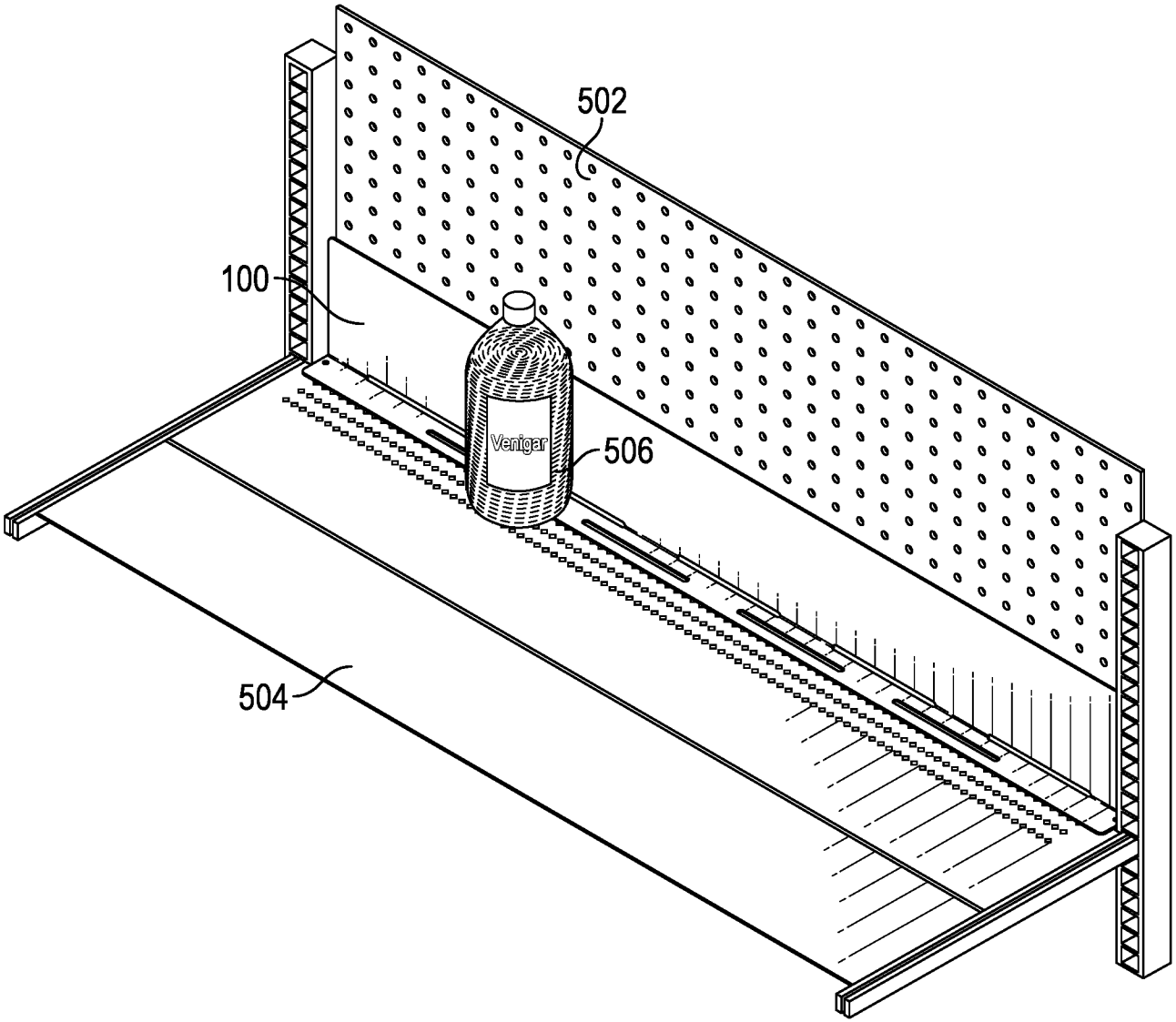
FIG. 5 is an illustrative view of the exemplary backstop shown in FIG. 1 illustrating the backstop on a shelf having a pegboard implemented behind the associated shelving unit according to an implementation.

Referring now to FIG. 5, an instance of the backstop 100 described in FIG. 1 is depicted as implemented on an intermediate shelf with a pegboard 502 implemented in the space behind the shelving unit. The backstop 100 when implemented on shelf 504 prevents item 506 from coming into contact with pegboard 502.

Figure 6:
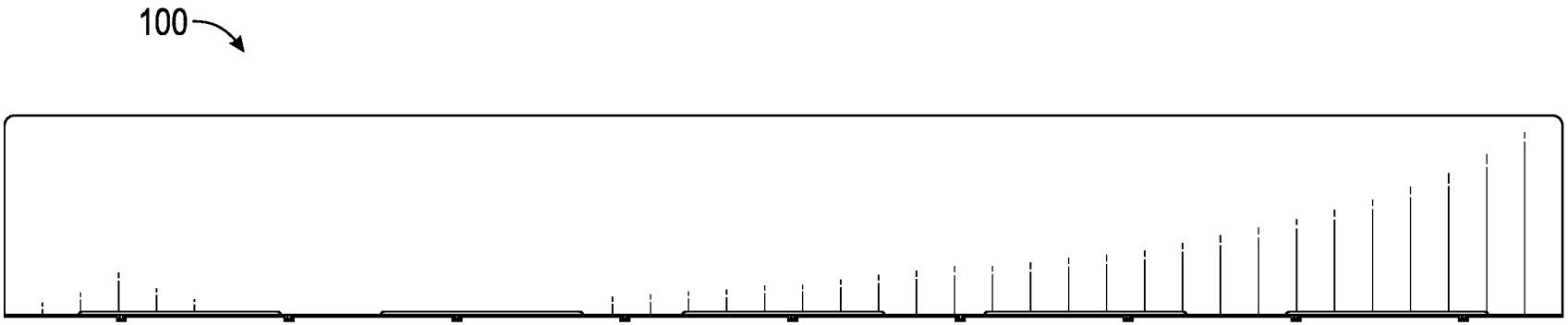
FIG. 6 is a front elevational view of the backstop shown in FIG. 1 according to an implementation.

FIG. 6 is a front elevational view of the backstop 100 shown in FIG. 1 according to an implementation.

Figure 7:
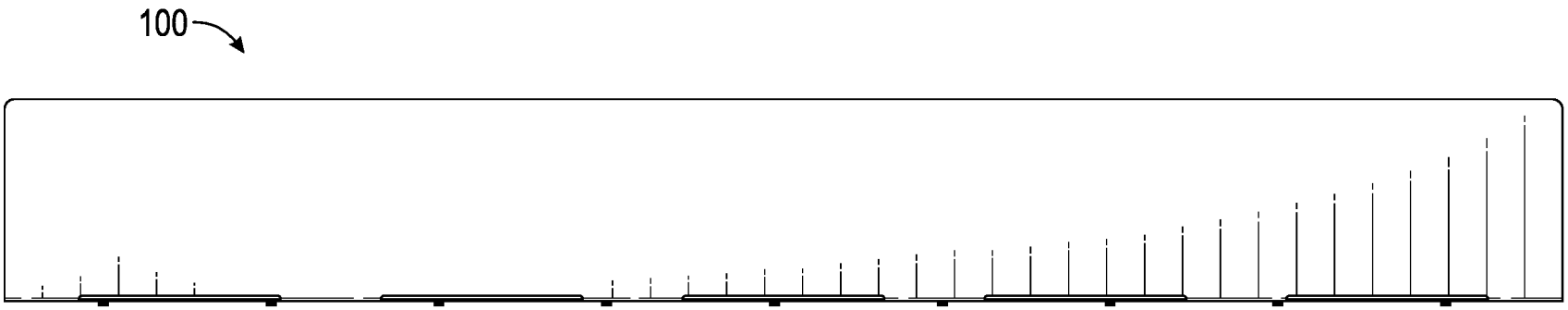
FIG. 7 is a back elevational view of the backstop shown in FIG. 1 according to an implementation.

FIG. 7 is a back elevational view of the backstop 100 shown in FIG. 1 according to an implementation.

Figure 8:
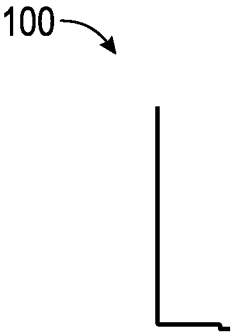
FIG. 8 is a side elevational view of the backstop shown in FIG. 1 according to an implementation.

FIG. 8 is a side elevational view of the backstop 100 shown in FIG. 1 according to an implementation.

Figure 9:
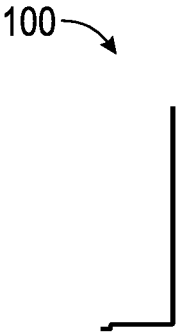
FIG. 9 is a side elevational view of the backstop shown in FIG. 1 according to an implementation.

FIG. 9 is a side elevational view of the backstop 100 shown in FIG. 1 according to an implementation.

Figure 10:
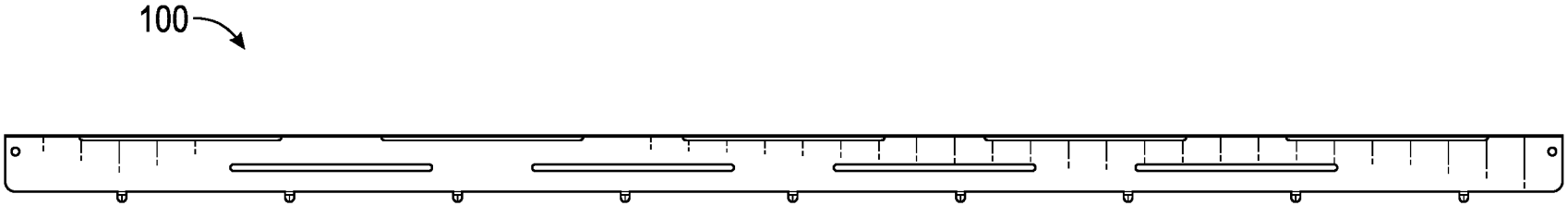
FIG. 10 is a top elevational view of the backstop shown in FIG. 1 according to an implementation.

FIG. 10 is a top elevational view of the backstop 100 shown in FIG. 1 according to an implementation.

Figure 11:
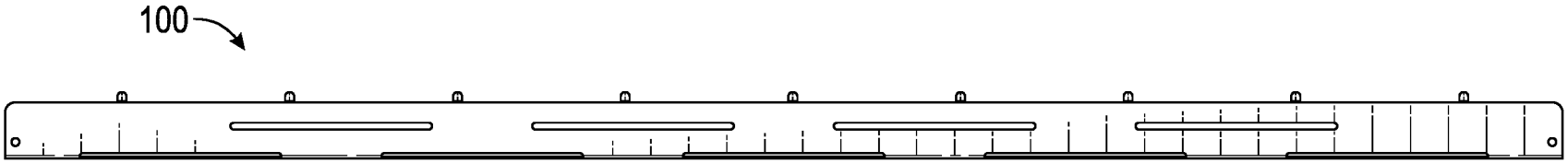
FIG. 11 is a bottom elevational view of the backstop shown in FIG. 1 according to an implementation.

FIG. 11 is a bottom elevational view of the backstop 100 shown in FIG. 1 according to an implementation.

Although a relative length of each backstop is shown herein, each backstop length may vary between any number of different lengths. Although a relative height of each backstop is shown herein, each backstop height may vary between any number of different heights and/or relative proportions to the bottom portion. In some examples, the backstop may be sized for a standard four foot gondola shelf, while in other examples the backstop may be sized for a three foot shelf or any other suitable size. In addition or alternative to the prongs and/or the apertures depicted herein, any other arrangement, geometry, structure, means, and/or the like may be used.

The following clauses describe further aspects:

A1. An apparatus comprising:

a bottom portion;

a back portion in continuous communication with a back edge of the bottom portion; and a plurality of prongs disposed along a front edge of the bottom portion.

A2. The apparatus of any preceding clause, wherein the plurality of prongs are disposed at intervals along the front edge, and wherein the plurality of prongs are configured to fit within apertures disposed along a surface of a shelf.

A3. The apparatus of any preceding clause, wherein the back portion is disposed at a 90° angle relative to the bottom portion.

A4. The apparatus of any preceding clause, further comprising:

one or more apertures disposed along a juncture between the back portion and the bottom portion.

A5. The apparatus of any preceding clause, further comprising:

one or more elliptical apertures disposed along a juncture between the back portion and the bottom portion.

A6. The apparatus of any preceding clause, further comprising:

a first fastening aperture disposed at a first end of the bottom portion relative to a length of the bottom portion; and a second fastening aperture disposed at a second end of the bottom portion relative to the length of the bottom portion, the first fastening aperture and the second fastening aperture configured for receiving a fastener to secure the apparatus to a shelving structure.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Any range or value given herein can be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above can relate to one implementation or can relate to several implementations. The implementations are not limited to those that solve any or all of the stated problems or those that have any or all of the stated benefits and advantages. It will further be understood that reference to 'an' item refers to one or more of those items.

The order of execution or performance of the operations in examples of the present application illustrated and described herein is not essential, unless otherwise specified. That is, the operations can be performed in any order, unless otherwise specified, and examples of the application can include additional or fewer operations than those disclosed herein. For example, it is contemplated that executing or performing a particular operation before, contemporaneously with, or after another operation (e.g., different steps, etc.) is within the scope of aspects and implementations of the application.

The term "comprising" is used in this specification to mean including the feature(s) or act(s) followed thereafter, without excluding the presence of one or more additional features or acts. The terms "comprising," "including," and "having" are intended to be inclusive and mean that there can be additional elements other than the listed elements. In other words, the use of "including," "comprising," "having," "containing," "involving," and variations thereof, is meant to encompass the items listed thereafter and additional items. Accordingly, and for example, unless explicitly stated to the contrary, implementations "comprising" or "having" an element or a plurality of elements having a particular property can include additional elements not having that property. Further, references to "one implementation" or "an implementation" are not intended to be interpreted as excluding the existence of additional implementations that also incorporate the recited features. The term "exemplary" is intended to mean "an example of".

When introducing elements of aspects of the application or the examples thereof, the articles "a," "an," "the," and "said" are intended to mean that there are one or more of the elements. In other words, the indefinite articles "a", "an", "the", and "said" as used in the specification and in the claims, unless clearly indicated to the contrary, should be understood to mean "at least one." Accordingly, and for example, as used herein, an element or step recited in the singular and preceded by the word "a" or "an" should be understood as not necessarily excluding the plural of the elements or steps.

The phrase "one or more of the following: A, B, and C" means "at least one of A and/or at least one of B and/or at least one of C." The phrase "and/or", as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e., "one or the other but not both") when preceded by terms of exclusivity, such as "either" "one of" "only one of" or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the application in detail, it will be apparent that modifications and variations are possible without departing from the scope of aspects of the application as defined in the appended claims. As various changes could be made in the above constructions, products, and methods without departing from the scope of aspects of the application, it is intended that all matter contained in the above description and shown in the accompanying drawings shall be interpreted as illustrative and not in a limiting sense.

It is to be understood that the above description is intended to be illustrative, and not restrictive. For example, the above-described implementations (and/or aspects thereof) can be used in combination with each other. In addition, many modifications can be made to adapt a particular situation or material to the teachings of the various implementations of the application without departing from their scope. While the dimensions and types of materials described herein are intended to define the parameters of the various implementations of the application, the implementations are by no means limiting and are example implementations. Many other implementations will be apparent to those of ordinary skill in the art upon reviewing the above description. The scope of the various implementations of the application should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various implementations of the application, including the best mode, and also to enable any person of ordinary skill in the art to practice the various implementations of the application, including making and using any devices or systems and performing any incorporated methods. The patentable scope of the various implementations of the application is defined by the claims, and can include other examples that occur to those persons of ordinary skill in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A shelving system comprising:

a backstop adapted to be attached to a shelf;

a bottom portion of the backstop comprising a first fastening aperture disposed at a first end of the bottom portion relative to a length of the bottom portion and a second fastening aperture disposed at a second end of the bottom portion relative to the length of the bottom portion, the first fastening aperture and the second fastening aperture each configured for receiving a fastener to secure the backstop to the shelf;

a back portion of the backstop in continuous communication with a back edge of the bottom portion and forming a 90° angle relative to the bottom portion at a juncture between the back portion and the bottom portion;

a plurality of apertures disposed at intervals along the juncture in communication with the back portion and the bottom portion; and a plurality of prongs disposed at intervals along a front edge of the bottom portion and configured to fit within apertures disposed along a surface of the shelf.

2. The shelving system of claim 1, wherein the plurality of apertures disposed along the juncture are substantially elliptical.

3. The shelving system of claim 1, wherein the bottom portion further comprises:

one or more bottom apertures disposed along the length of the bottom portion.

4. The shelving system of claim 1, further comprising:

the first fastening aperture and the second fastening aperture configured for receiving a first fastener and a second fastener, respectively, to secure another system or apparatus to be fastened through the backstop and onto the shelf, wherein implementation of the backstop does not preclude implementation of other compatible systems.

5. The shelving system of claim 1, wherein the backstop is formed from a single piece of material.

6. The shelving system of claim 1, wherein the back portion is substantially solid.

7. A backstop for a shelf, the backstop comprising:

a bottom portion comprising a first fastening aperture disposed at a first end of the bottom portion of the backstop relative to a length of the bottom portion and a second fastening aperture disposed at a second end of the bottom portion relative to the length of the bottom portion, the first fastening aperture and the second fastening aperture each configured for receiving a fastener to secure the backstop to the shelf;

a back portion in continuous communication with a back edge of the bottom portion of the backstop forming a 90° angle relative to the bottom portion at a juncture between the back portion of the backstop and the bottom portion;

a plurality of apertures disposed at intervals along the juncture in communication with the back portion and the bottom portion; and a plurality of prongs disposed at intervals along a front edge of the bottom portion and configured to fit within apertures disposed along a surface of the shelf.

8. The backstop of claim 7, wherein the plurality of apertures disposed along the juncture are substantially elliptical.

9. The backstop of claim 7, wherein the bottom portion further comprises:

one or more bottom apertures disposed along the length of the bottom portion.

10. The backstop of claim 7, further comprising:

the first fastening aperture and the second fastening aperture configured for receiving a first fastener and a second fastener, respectively, to secure another system or apparatus to be fastened through the backstop and onto the shelf, wherein implementation of the backstop does not preclude implementation of other compatible systems.

11. The backstop of claim 7, wherein the bottom portion and the back portion of the backstop comprise a single piece of material.

12. The backstop of claim 7, wherein the back portion is substantially solid.

* * * * *